US007712739B2

(12) United States Patent
Yoshimizu

(10) Patent No.: US 7,712,739 B2
(45) Date of Patent: May 11, 2010

(54) CONVEYING APPARATUS, INKJET RECORDING APPARATUS, AND METHOD FOR CONTROLLING CONVEYANCE

(75) Inventor: Eiki Yoshimizu, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 1177 days.

(21) Appl. No.: 11/121,273

(22) Filed: May 3, 2005

(65) Prior Publication Data

US 2005/0253920 A1 Nov. 17, 2005

(30) Foreign Application Priority Data

May 11, 2004 (JP) ..... 2004-141094

(51) Int. Cl.
*B65H 5/00* (2006.01)

(52) U.S. Cl. ..... 271/264; 347/104

(58) Field of Classification Search ..... 271/198, 271/202, 203, 264

See application file for complete search history.

(56) References Cited

U.S. PATENT DOCUMENTS

| | | | | |
|---|---|---|---|---|
| 4,849,795 | A * | 7/1989 | Spehrley et al. | 399/394 |
| 5,598,201 | A * | 1/1997 | Stodder et al. | 347/104 |
| 6,155,669 | A * | 12/2000 | Donahue et al. | 347/42 |
| 6,407,678 | B1 * | 6/2002 | Elgee et al. | 341/8 |
| 6,687,458 | B2 * | 2/2004 | Masuda | 396/55 |
| 6,909,516 | B1 * | 6/2005 | Hoover | 356/615 |
| 2002/0126193 | A1 * | 9/2002 | Maki et al. | 347/104 |

FOREIGN PATENT DOCUMENTS

| | | |
|---|---|---|
| JP | 59-225409 | * 12/1984 |
| JP | 5-26411 | 4/1993 |
| JP | 5-297737 | 11/1993 |
| JP | 7-304222 | 11/1995 |
| JP | 8-25699 | 1/1996 |
| JP | 2000-191175 | 7/2000 |
| JP | 2002-248822 | 9/2002 |
| JP | 2003-103857 | 4/2003 |
| JP | 2003-280484 | 10/2003 |
| JP | 2004-17505 | 1/2004 |

OTHER PUBLICATIONS

Sep. 30, 2008 official action in connection with a counterpart Japanese patent application No. 2004-141094.

* cited by examiner

*Primary Examiner*—Patrick H Mackey
*Assistant Examiner*—Thomas A Morrison
(74) *Attorney, Agent, or Firm*—Cooper & Dunham LLP

(57) ABSTRACT

A recording paper conveying apparatus is disclosed. The recording paper conveying apparatus includes a conveying part for conveying a recording paper, the conveying part including a first encoder, and a driving part for driving the conveying part, the driving part including a second encoder, wherein the first and second encoders have different resolutions.

10 Claims, 5 Drawing Sheets

CONVEYING APPARATUS, INKJET RECORDING APPARATUS, AND METHOD FOR CONTROLLING CONVEYANCE

BACKGROUND OF THE INVENTION

1. Technical Field

This disclosure relates to a recording paper conveying apparatus, an inkjet recording apparatus, and a method for controlling the conveyance of recording paper, and more particularly, to a recording paper conveying apparatus, an inkjet recording apparatus, and a method for controlling the conveyance of recording paper by a recording paper conveying apparatus with high precision.

2. Description of the Related Art

Recently, in the field of inkjet recording technology, the types of ink used for recording are shifting from dye type inks to pigment type inks for improving light resistance and aging resistance (resistance against deterioration in association with time). In addition, the viscosity of the ink is becoming higher. Although the increase in the viscosity of the ink has reduced creation of bleeding on the recording paper considerably, inaccurate disposition of ink droplets where ink droplets deviate from a target contact area (e.g. white stripes, black stripes, banding) is more visible. Since the disposition of ink droplets largely relies on the precision of the stop position during conveyance of a recording paper in a sub-scanning direction, it is desired to increase the precision in conveying the recording paper.

Conventionally, a grinding conveyor roller or a conveyor belt is employed in a sub-scan recording paper conveying mechanism used for inkjet recording. In controlling the amount of conveyance with the conveying mechanism, a code wheel is provided on an axle of a conveying roller for allowing an encoder sensor to read and control the conveyance according to a value obtained from the code wheel. For example, Japanese Laid-Open Patent Application No. 2002-248822 shows a configuration where a conveying roller and a discharge roller are situated at an upstream side and a downstream side of a platen for conveying a recording paper in a sub-scanning direction. This configuration has a code wheel provided on an axle of the conveying roller for allowing an encoder sensor to read and control the conveyance according to a value obtained from the code wheel.

However, the conventional recording paper conveying mechanism using the code wheel and the sensor for controlling the conveyance of the recording paper has difficulty in achieving stop position control with satisfactory precision due to overlapping error among its components (e.g. pulley, conveying roller, etc.).

SUMMARY

In an aspect of this disclosure, there is provided a recording paper conveying apparatus including: a conveying part for conveying a recording paper, the conveying part including a first encoder; and a driving part for driving the conveying part, the driving part including a second encoder; wherein the first and second encoders have different resolutions.

In an embodiment of this disclosure, when the recording paper is conveyed for a predetermined amount by the conveying part, a relation of $N=a \cdot n1+n2$ may be satisfied, wherein "a" is a correlation function representing a ratio between "L1" and "L2", wherein "L1" is the amount of conveyance of the conveying part corresponding to a single pulse of a signal output from one of the first encoder and second encoder having a lower resolution, wherein "L2" is the amount of conveyance of the conveying part corresponding to a single pulse of a signal output from one of the first encoder and second encoder having a higher resolution, wherein "N" is the number of pulses of the signal of the encoder having the higher resolution being output in correspondence with the predetermined amount of conveyance of the conveying part, wherein "n1" is the number of pulses of the encoder having the lower resolution, wherein "n2" is the number of pulses of the encoder having the higher resolution, wherein "n2" is an integer that satisfies a relation of $0 \leqq n2 < a$.

In the recording paper conveying apparatus according to an embodiment of this disclosure, the driving part may be driven by employing closed-loop control based on the output signals of the first and second encoders.

In the recording paper conveying apparatus according to an embodiment of this disclosure, the driving part may be driven by employing open-loop control.

In the recording paper conveying apparatus according to an embodiment of this disclosure, the recording paper conveying apparatus may further include a correcting part for correcting the correlation function "a".

In the recording paper conveying apparatus according to an embodiment of this disclosure, the recording paper conveying apparatus may further include a temperature detecting part for detecting a predetermined temperature, wherein the correcting part corrects the correlation function "a" in accordance with the detected temperature.

In the recording paper conveying apparatus according to an embodiment of this disclosure, the conveying part may include a conveyor belt.

In the recording paper conveying apparatus according to an embodiment of this disclosure, the conveyor belt may include an attracting part for holding the recording paper.

In the recording paper conveying apparatus according to an embodiment of this disclosure, the attracting part may include an electrostatic attraction part.

In the recording paper conveying apparatus according to an embodiment of this disclosure, the attracting part may use negative pressure for attracting the recording paper.

In the recording paper conveying apparatus according to an embodiment of this disclosure, the first encoder may include a linear encoder having a linear scale provided on the conveyor belt and a first sensor for reading the linear scale, wherein the second encoder may include a rotary encoder including a code wheel mounted on the driving part and a second sensor for reading the code wheel, wherein the rotary encoder may have a resolution higher than that of the linear encoder.

In the recording paper conveying apparatus according to an embodiment of this disclosure, the linear scale may be disposed at a rear face of the conveyor belt.

In the recording paper conveying apparatus according to an embodiment of this disclosure, the linear scale may be fabricated by aluminum evaporation.

In the recording paper conveying apparatus according to an embodiment of this disclosure, the recording paper conveying apparatus may further include a border detection sensor for detecting a border of the linear scale, wherein data of the linear encoder is complemented with data of the rotary encoder when the border detection sensor detects the border of the linear scale.

In the recording paper conveying apparatus according to an embodiment of this disclosure, the linear encoder and the rotary encoder may output a predetermined signal in accordance with the reading from the linear scale and the code wheel, respectively, wherein the predetermined signal includes a rectangular digital signal.

In the recording paper conveying apparatus according to an embodiment of this disclosure, the linear encoder and the rotary encoder may output a predetermined signal in accordance with the reading from the linear scale and the code wheel, respectively, wherein the predetermined signal includes an analog signal.

In the recording paper conveying apparatus according to an embodiment of this disclosure, the resolution of the linear encoder may be no less than 100 LPI.

In the recording paper conveying apparatus according to an embodiment of this disclosure, the resolution of the rotary encoder may be no less than 300 LPI.

In the recording paper conveying apparatus according to an embodiment of this disclosure, the output signal of the rotary encoder may be multiplied by a predetermined value.

Further, there is provided an inkjet recording apparatus including the recording paper conveying apparatus according to an embodiment of this disclosure, the recording paper conveying apparatus being mounted onto an inkjet engine portion for conveying the recording paper in a sub-scanning direction.

Further, there is provided a method for controlling conveyance of a recording paper conveying apparatus including a conveying part for conveying a recording paper and a driving part for driving the conveying part, the conveying part including a first encoder, the driving part including a second encoder, the first and second encoders having different resolutions, the method including a step of: controlling the amount of conveyance of the conveying part based on signals output from the first and second encoders.

Other aspects and further features will be apparent from the following detailed description when read in conjunction with the accompanying drawings.

DESCRIPTION OF THE PREFERRED EMBODIMENTS

In the following, embodiments of the present invention are described with reference to the accompanying drawings.

Figure 1:
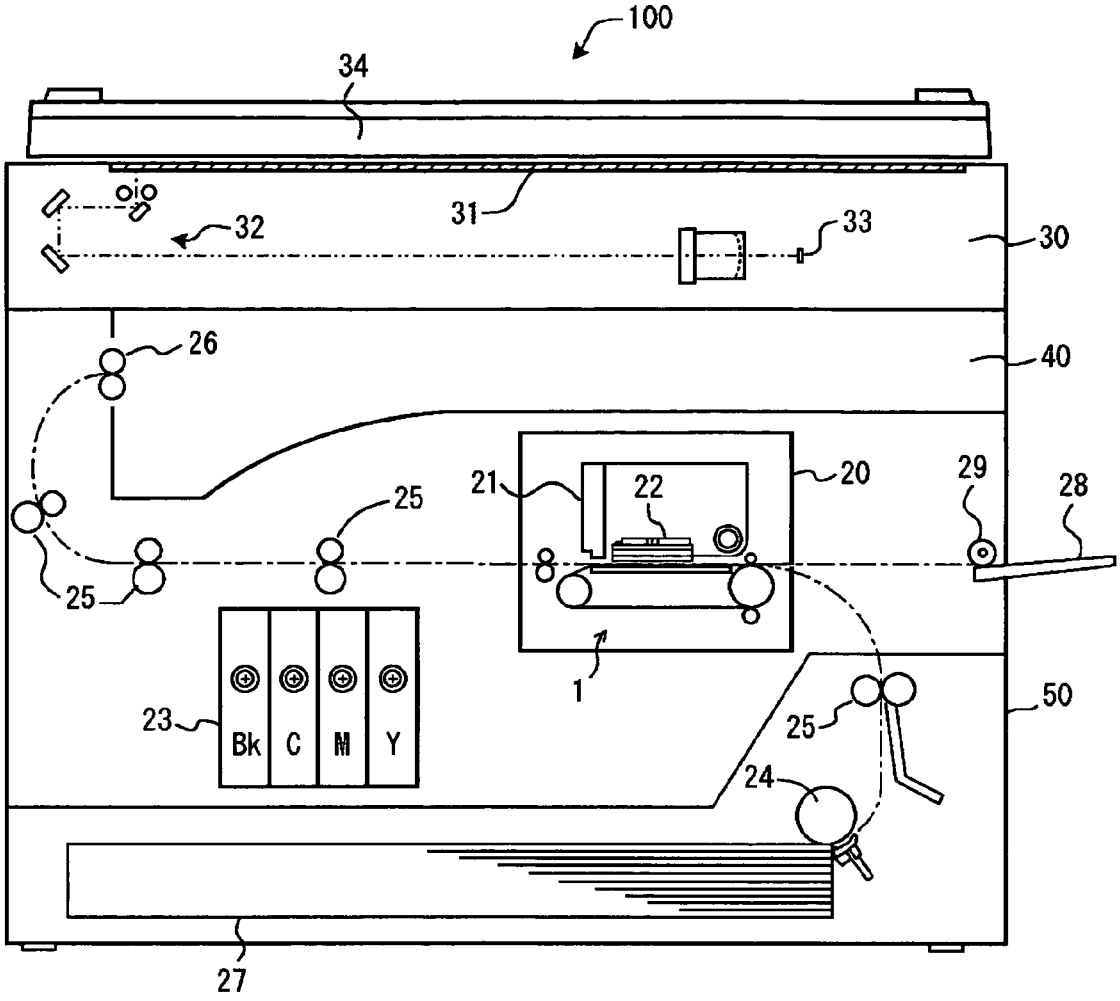
FIG. 1 is a cross-sectional view of an exemplary configuration of an inkjet recording apparatus including a recording paper conveying apparatus according to an embodiment of the present invention.

FIG. 1 is a cross-sectional view of an exemplary configuration of an inkjet recording apparatus 100 including a recording paper conveying apparatus 1 according to an embodiment of the present invention. In this example, the recording paper conveying apparatus 1 is able to intermittently convey a recording paper(s). Furthermore, in this example, the inkjet recording apparatus 100 serves as a copying apparatus having a scanner portion 30 situated above a printer part 50. A paper discharge portion 40 is situated between the scanner portion 30 and the printer portion 50.

In the scanner portion 30, a scanning part 32 is provided below a contact glass 31 in a manner operable to execute scanning. Accordingly, the light irradiated from a light source is reflected from an original and introduced to a CCD 33 via a mirror lens, etc., to thereby allow the CCD 33 to read an image of the original. A platen 34 is provided in an openable-closable manner above the contact glass 31.

A recording paper conveyance path, which starts from a paper feed cassette 27 situated at a lower part of the printer portion 50 and terminates at the paper discharge portion 40, is formed in a manner indicated with a one-dot chain line in FIG. 1. One or more conveying rollers 25 are suitably provided at predetermined parts of the recording paper conveyance path. It is to be noted that reference numeral 24 indicates a paper feed roller and reference numeral 26 indicates a paper discharge roller. Furthermore, a manual feed tray 28 is provided at a side of the inkjet recording apparatus 100, so that recording paper may also be fed from the manual feed tray 28 via the paper feed roller 24.

An inkjet engine 20 includes the recording paper conveying apparatus 1. In this example, the recording paper conveying apparatus 1 employs a system which conveys the recording paper in a sub-scanning direction by using an electrostatic attraction belt (conveyor belt) 2. The conveying system using the electrostatic attraction belt is able to convey paper more steadily compared to using a conventional roller conveying type. A carriage 21, which is situated above the recording paper conveying apparatus 1, is mounted with a print head(s) 22. A printing operation is executed by moving the carriage 21 back and forth in a main scanning direction (vertical direction in FIG. 1) and jetting ink droplets from the print head 22. The print head 22 is provided with a nozzle alignment with a length of 1.27 inches, being longer than that of a conventional print head. In this example, the print head 22 may be of a four head configuration, in which one head corresponds to each color of cyan (C), magenta (M), yellow (Y), and black (Bk). The number of heads is not limited to four heads. Alternatively, the print head 22 may be of a two head configuration, in which one head corresponds to two colors.

In this example, ink cartridges 23 corresponding to each color are mounted on the inkjet recording apparatus 100 separately from the aforementioned print head 22. The inks contained in the ink cartridges 23 are supplied to the print head 22 via a supply tube (not shown). The configuration provided with separately mounted cartridges and the print heads is suitable for business purposes since the configuration allows a large capacity type cartridge to be used in handling increased ink consumption along with accelerated print speed.

Figure 2:
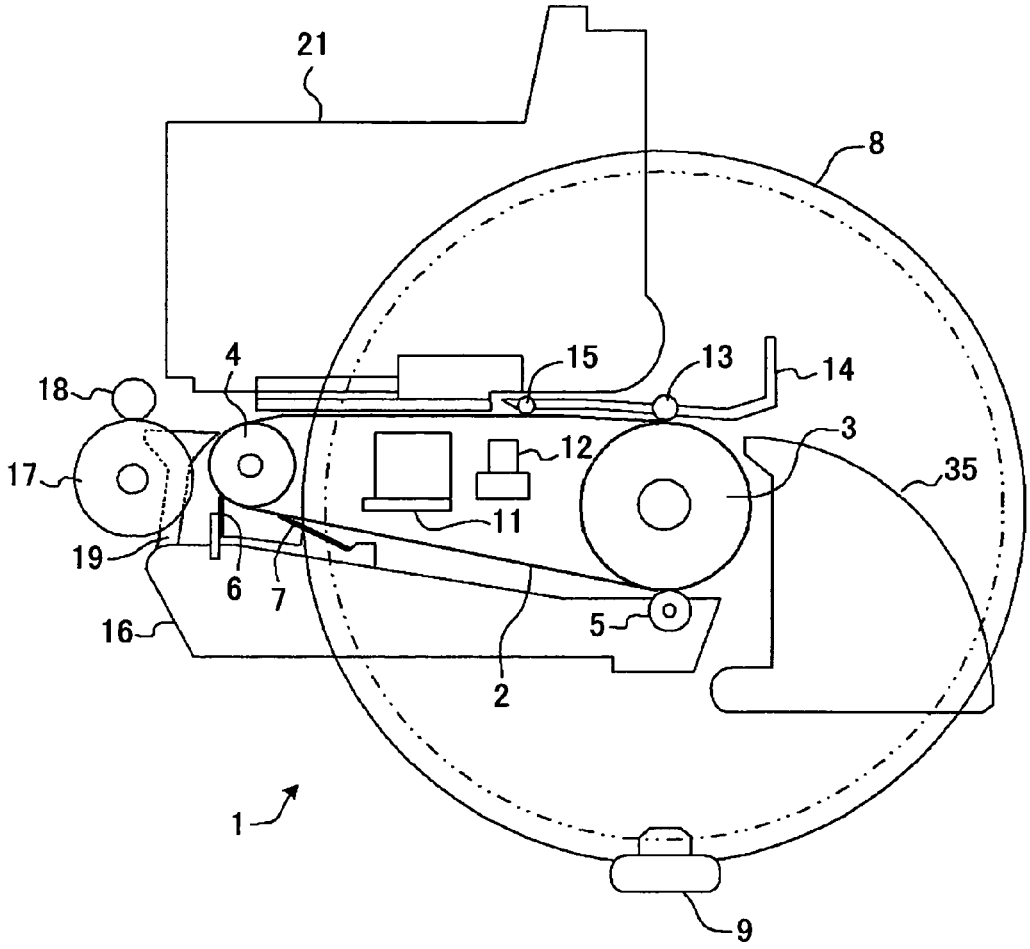
FIG. 2 is a detailed drawing of an exemplary configuration of a recording paper conveying apparatus according to an embodiment of the present invention.

FIG. 2 is a detailed drawing of the recording paper conveying apparatus 1 according to an embodiment of the present invention.

In FIG. 2, the electrostatic attraction belt (conveyor belt) 2, which is a conveying part for conveying a recording paper in a sub-scanning direction, is formed as an endless belt hung around by a conveying roller 3 and a tension roller 4. A charge roller 5 for applying charge to the electrostatic attraction belt 2, a charge removing brush 6 for removing electric charge from the electrostatic attraction belt 2, and a cleaning blade 7 for cleaning the electrostatic attraction belt 2 are disposed abutting an outer surface of the electrostatic attraction belt 2. The charge roller 5, the charge removing brush 6, and the cleaning blade 7 are supported by a bracket 16. A collecting part is provided on the bracket 16 for storing residual paper particles, ink stains, etc., removed from the electrostatic attraction belt 2 by the cleaning blade 7.

A pressure roller 13 supported by a pressure plate 14 is disposed in a manner facing the conveying roller 3. A tip pressure roller 15 is supported at a tip of the pressure plate 14. The tip pressure roller 15 serves to press the electrostatic attraction belt 2 against a platen 10 situated at an inner side of an upper plane portion of the electrostatic attraction belt 2 (See FIG. 3).

A guiding member 35 is disposed at a side of the conveying roller 3 by which the recording paper fed from the paper feed portion is guided to an area between the conveying roller 3 (electrostatic attraction belt 2) and the pressure plate 14. The recording paper, which is electrostatically attracted to and held on an upper surface of the electrostatic attraction belt 2 by electrostatic force, is conveyed in a sub-scanning direction (s) (for example, from right to left in FIGS. 1, 2, 3) by the electrostatic attraction belt 2 rotating in a predetermined direction(s) (for example, the counterclockwise direction in FIGS. 1, 2, 3).

A pair of paper discharge rollers including a paper discharge roller part 17 and a spur part 18 is disposed at a downstream side of the tension roller 4. A separating claw 19 for separating the recording paper from the electrostatic attraction belt 2 is provided at a portion at which the tension roller 4 is situated. The recording paper separated from the electrostatic attraction belt 2 is then delivered further downstream by the pair of paper discharge rollers including the paper discharge roller part 17 and the spur part 18.

A code wheel 8 having a high resolution is attached to an axle of the conveying roller 3. A slit(s) (not shown) is formed in the code wheel 8. A transparent type encoder sensor 9 is provided for detecting the slit(s). A rotary encoder according to an embodiment of the present invention includes the code wheel 8 and the encoder sensor 9. It is preferable to use a rotary encoder having an LPI value no less than 300 LPI and a CR (CPR) value no less than 4800 CR (CPR).

Furthermore, a linear scale (not shown) may be formed at a predetermined portion of the electrostatic attraction belt 2, such as a rear face of the electrostatic attraction belt 2. The linear scale may be fabricated by, for example, depositing aluminum to the rear face of the electrostatic attraction belt 2 (forming stripe patterns by performing aluminum deposition and laser irradiation on the rear face of the electrostatic attraction belt 2). The linear scale is disposed at the predetermined portion for preventing the platen 10 situated on the rear face of the electrostatic attraction belt 2 from obstructing the linear scale. A reflection type encoder sensor 11 is disposed within the loop of the electrostatic attraction belt 2 for reading the linear scale. A linear encoder according to an embodiment of the present invention includes the linear scale and the encoder sensor 11. It is preferable to use a linear encoder having an LPI value (resolution) no less than 100 LPI. The linear encoder used in this example has a resolution of 150 LPI. It is to be noted that a border detection sensor 12 for detecting a joint area (border) of the linear scale is situated adjacent to the encoder sensor 11.

One of the features of the recording paper conveying apparatus 1 according to an embodiment of the present invention is that the electrostatic attraction belt 2, being the conveying part, is controlled with use of two kinds of encoders where one is the rotary encoder and the other is the linear encoder.

Figure 3:
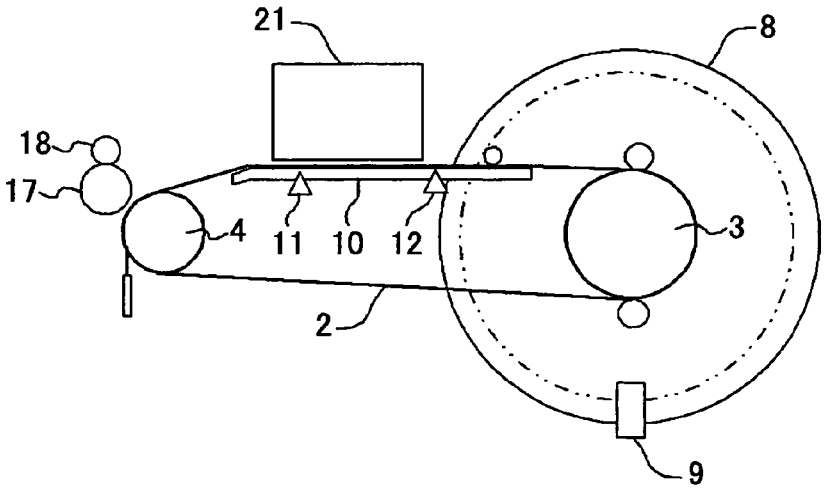
FIG. 3 is a schematic drawing of an exemplary configuration of a recording paper conveying apparatus according to an embodiment of the present invention.
Figure 4:
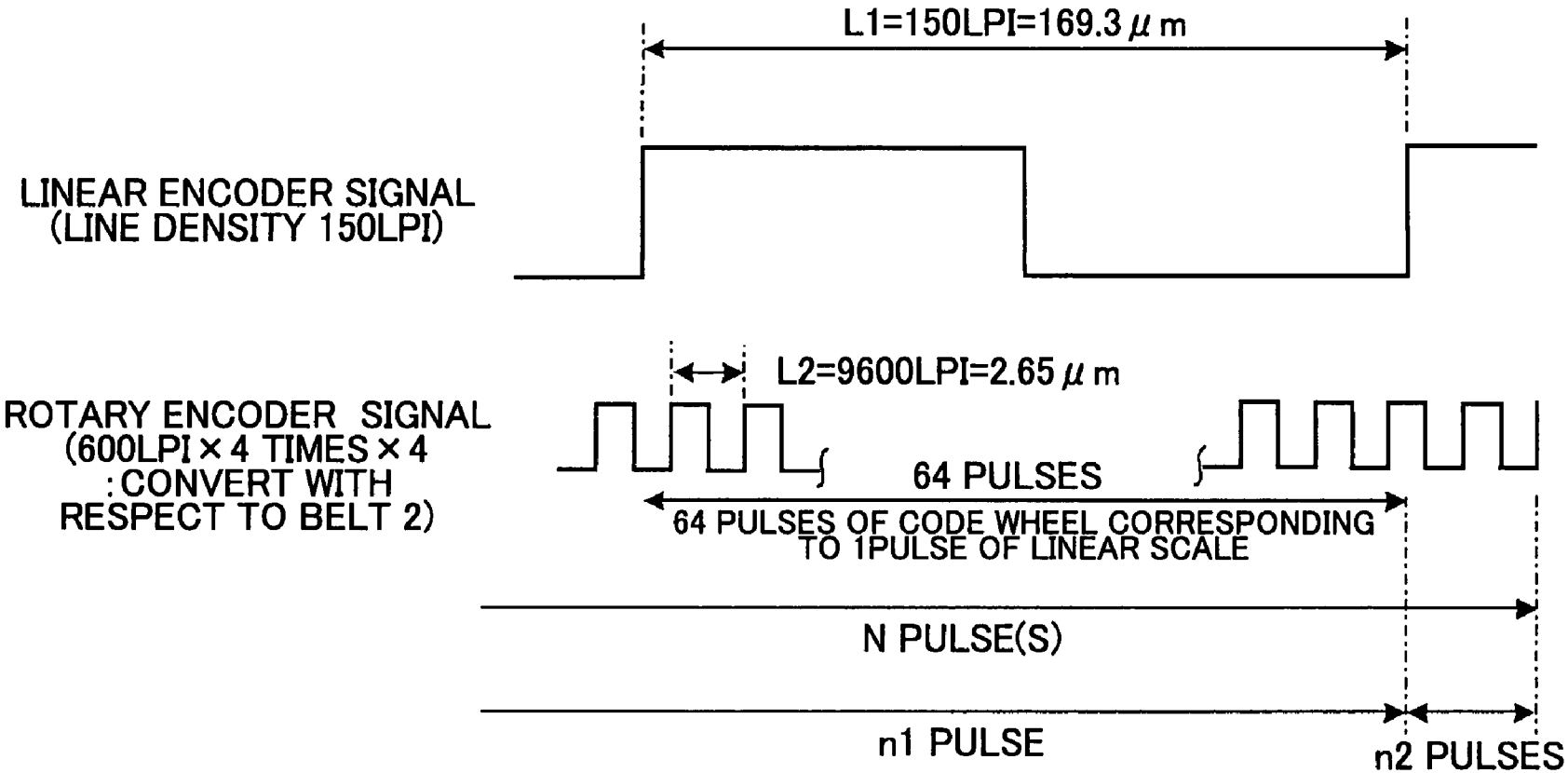
FIG. 4 is a diagram for schematically illustrating signal processes executed by a rotary encoder and a linear encoder according to a double sensor method.

Next, the control of the conveyance of the electrostatic attraction belt 2 according to an embodiment of the present invention is described with reference to FIGS. 3 and 4. It is to be noted that FIG. 3 is a schematic drawing of the recording paper conveying apparatus 1 illustrated in detail in FIG. 2. Furthermore, FIG. 4 is a diagram for schematically illustrating signal processes executed by the rotary encoder and the linear encoder according to a double sensor method according to an embodiment of the present invention.

As the electrostatic attraction belt 2 is moved by the rotation of the conveying roller 3, the linear scale disposed at the rear face of the electrostatic attraction belt 2 is also moved so as to allow information (data) to be read therefrom by the reflection type encoder sensor 11. Then, signals are output in accordance with the read information. The signals may be analog sinusoidal waves or rectangular waves. Here, the signals are described as being rectangular waves.

In this example, the reflection type encoder sensor 11 reads position information for a cycle of 150 LPI (See FIG. 4) and outputs a rectangular wave signal(s) (linear encoder signal). In the same manner, the transparent type encoder sensor 8 reads information from the code wheel 8 situated on the axle of the conveying roller 3 and outputs another rectangular wave signal(s) (rotary encoder signal). It is to be noted that, in this example, the resolution of the rotary encoder is set with a resolution greater (higher) than that of the linear encoder.

Although the resolution of the linear scale provided on the electrostatic attraction belt 2 is indicated in an amount as it is, the amount (distance) of a single resolution of the code wheel 8 with respect to the electrostatic attraction belt 2, on the other hand, is to be determined in accordance with the number of pulses in a single rotation, the conveying roller 3 diameter, and the electrostatic attraction belt 2 thickness. That is, the number of pulses for a single rotation becomes greater as the resolution of the code wheel 8 (i.e. density of the pitch of the slits) and/or the outer diameter of the code wheel 8 becomes greater. Furthermore, the amount of conveyance (movement) corresponding to a single pulse of the rotary encoder becomes smaller as the diameter of the conveying roller 3 becomes smaller. In this example, the resolution (output) of the code wheel 8 being 600 LPI is multiplied (in this example, by 4) to a value of 2400 LPI. Furthermore, since the relation between the diameter of the code wheel 8 and the diameter of the conveying roller 3 (including the thickness of the electrostatic attraction belt 2) is set at 4:1, the multiplied value is further multiplied by a value of 4 (2400 LPI×4). Accordingly, the resolution of the rotary encoder converted with respect to the electrostatic attraction belt 2 is 9600 LPI. Hence, the amount of conveyance of the electrostatic attraction belt 2 corresponding to a single resolution of the rotary encoder is approximately 2.65 μm.

That is, as shown in FIG. 4, a linear scale cycle L1 is equal to 150 LPI and approximately 169.3 μm (i.e. L1=150 LPI=approximately 169.3 μm). On the other hand, the converted value L2 of the rotary encoder with respect to the electrostatic attraction belt 2 is equal to 9600 LPI (600 LPI×4×4) and approximately 2.65 μm (i.e. L2=9600 LPI=approximately 2.65 μm. It is to be noted that the value of the resolution can be designated in accordance with desired precision and cost.

This example is a case where the electrostatic attraction belt 2 is moved (or conveys the recording paper) for a predetermined amount (distance) in correspondence with N pulse (s) of the rotary encoder signal. Here, in this example, the distance L1 corresponding to a single pulse of the linear encoder and the distance L2 corresponding to a single pulse of the rotary encoder satisfy a relation of L1=L2×64. The amount of movement corresponding to N pulses is indicated with the below-given formula (1), wherein the number of pulses of the linear encoder is n1, and the additional fraction of the rotary encoder is n2 (0-63).

$$N=64\times n1+n2 \quad \text{formula (1)}$$

In indicating the amount of movement in the form of distance, the amount of movement (conveyance) satisfies a relation of 2.65 μm×N=169.3 μm×n1+2.65 μm×n2 (however, the values of 169.3 μm and 2.65 μm differ depending on the encoders that are used). In a case where N=1000 pulses (amount of movement 2.65 μm), n1=15 and n2=40.

It is to be noted that, since the value of 64 in formula (1) represents the ratio of L1 and L2, this can be expressed as the below-given formula (2) using "a" as a correlation function.

$$N=a\cdot n1+n2 \quad \text{formula (2)}$$

Accordingly, in a case of obtaining the number of pulses n1 of the linear encoder and the number of pulses n2 of the rotary encoder for moving the electrostatic attraction belt 2 for a predetermined amount (distance), first, the number of pulses N (in this example, 1000 pulses) is divided by the correlation function "a" of L1 and L2 (in this example, 9600 LPI/150 LPI=64). The integer part (in this example, 15) of the quotient (in this example, 15.625) is the number of pulses n1 of the linear encoder. Next, the number of pulses n2 of the rotary encoder is obtained by using the formula (2), in which $$n2=N-a\cdot n1=1000-64\times 15=1000-960=40.$$

In other words, in obtaining the amount of movement, first, the number of pulses of the encoder having a low resolution is determined (to an extent not surpassing the amount of movement), and then the number of pulses of the encoder having a higher resolution, which corresponds to the fraction (remaining distance), is obtained. For example, in a case where the amount of movement is 5.3 mm, N=2000. Therefore, the integer part 31 of the quotient for 2000÷64 is the number of pulses n1 of the linear encoder. Thus, the number of pulses n2 of the rotary encoder is 16 (n2=2000−64×31=16).

In this example, the amount of movement (conveyance) is designated according to the number of pulses N for the rotary encoder. Nevertheless, since only the fractions (0-63) of the signals of the rotary encoder are actually used, the influence of errors among the components can be reduced. A large portion of the amount of movement (amount of conveyance) can be controlled according to the linear encoder signals n1. In this example, the rotary encoder covers a small proportion with respect to the actual movement amount of the electrostatic attraction belt 2 since the distance L2 of a single pulse of the rotary encoder is 1/64 the distance L1 of a single pulse of the linear encoder. Accordingly, the influence of the errors among the components can be controlled.

Although the foregoing examples employ the relation of L1=L2×64 for the sake of convenience, there may be a case where the correlation function is not an integer (e.g. 64.2 instead of 64) by comparing the rotary encoder signal corresponding to a single rotation of the conveying roller with the linear encoder signal. Furthermore, the stretch of the electrostatic attraction belt 2 due to temperature may be corrected by changing the correlation function. For example, by providing a temperature sensor for detecting a predetermined temperature (e.g. temperature of the electrostatic attraction belt 2) and changing the correlation function "a" based on an output detected by the temperature sensor, correction of the temperature stretch of the belt can be automatically executed.

Figure 5:
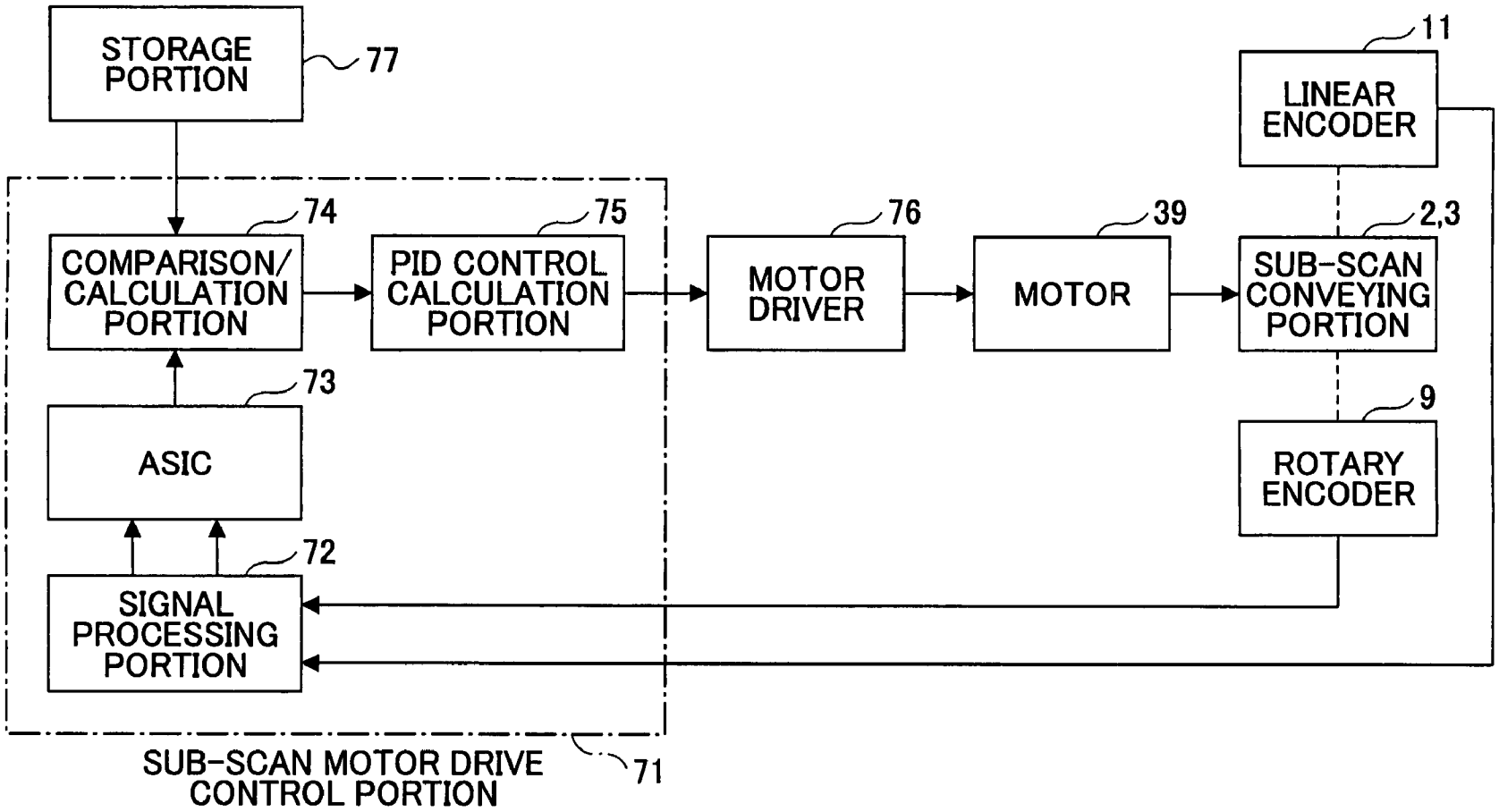
FIG. 5 is a block diagram for explaining functions of a drive control system for sub-scanning with the inkjet recording apparatus shown in FIG. 1.

FIG. 5 is a block diagram for explaining functions of a control system for executing the sub-scan drive control as described above.

Figure 6:
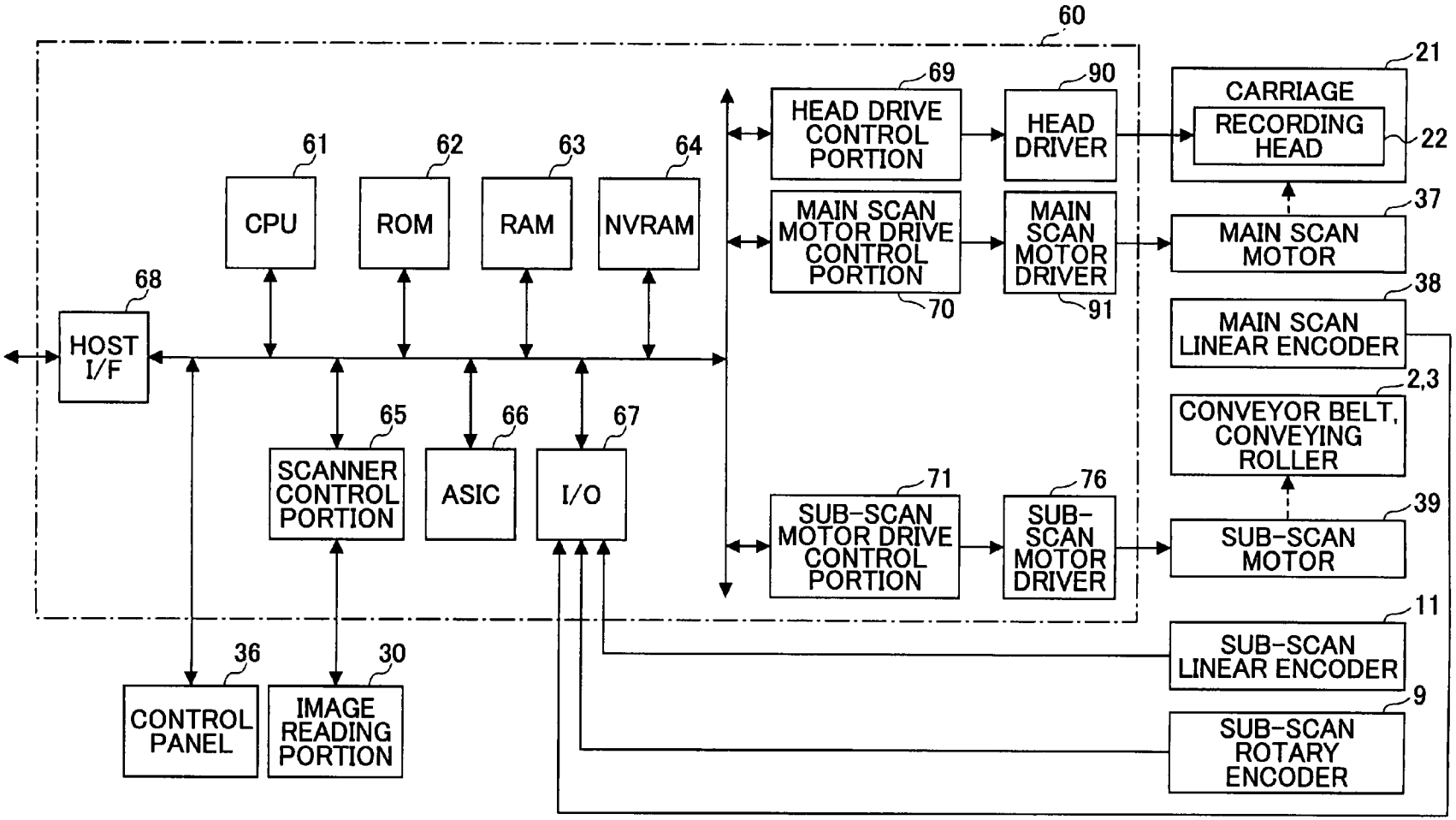
FIG. 6 is a block diagram showing a control part of the inkjet recording apparatus shown in FIG. 1.

As shown in FIG. 6, the signals from the linear encoder (encoder sensor 11) and the rotary encoder (encoder sensor 9) are converted to speed/position information (data) at a signal processing portion 72 in a sub-scan motor drive control portion 71. The information is synthesized at an ASIC (Application Specific Integrated Circuit) 73 and is compared at a comparison/calculation portion 74 with respect to the speed/position profile stored in a storage portion 77. Based on the deviation obtained from the comparison, a PID control calculation portion 75 calculates a PWM signal(s) for controlling the drive of a motor driver 76. The PWM signal is transmitted to the motor driver 76 for allowing a predetermined amount of current to flow from the motor driver 76 to a motor 39. This flow of current serves to drive a sub-scan drive portion.

Using the sensor information from the linear scale provided to the electrostatic attraction belt 2 and the sensor information from the code wheel 8 in combination enables the speed/position of the electrostatic attraction belt 2 to be controlled by employing closed loop control (feedback control). Thereby, the stop position of the electrostatic attraction belt 2 can be accurately controlled. It is to be noted that, although closed loop control is employed in this embodiment of the present invention, other methods of control such as an open loop control may alternatively be employed.

Even if the conventional recording paper conveying apparatus is provided with a high resolution rotary encoder for controlling a rotary member, recording paper cannot be conveyed with high precision due to overlapping of errors among the components resulting from, for example, eccentricity or run-out of the drive member (e.g. gear, pulley) and/or the conveying roller, deviation of belt thickness, and/or error caused by temperature change (changes in diameter).

Meanwhile, according to the above-described embodiment of the present invention, a large proportion of conveyance control is handled by the linear encoder having the encoder sensor 11 reading the linear scale provided to the electrostatic attraction belt 2. Therefore, the conveying roller 3 (rotary encoder), which is susceptible to the problem of overlapping errors, handles only a small proportion of conveyance control. Thus, by providing the rotary encoder with a high resolution, the precision of controlling the electrostatic attraction belt 2 (conveyance of recording paper) can be further improved.

In the above-described embodiment of the present invention, the amount (distance) of movement of the electrostatic attraction belt 2 may be considered as corresponding to the amount (distance) of conveyance (movement) of the recording paper since the recording paper is conveyed in a manner attracted (held) on the electrostatic attraction belt 2. Therefore, precise control of the electrostatic attraction belt 2 results in precise control of the position of the recording paper. With the inkjet engine 20 according to the embodiment of the present invention, the stop position of the recording paper in the sub-scan direction can be precisely controlled, to thereby prevent degradation of image quality caused by ink droplets deviating from a target position. As a result, high image quality can be obtained.

Meanwhile, according to an embodiment of the present invention, the border detection sensor 12 is situated upstream of the encoder sensor 11 for detecting the border (joint area) of the linear scale prior to reaching the encoder sensor 11. In this example, the border detection sensor 12 is a reflection type photosensor. When the border detection sensor 12 detects the border (joint area) of the linear scale, the position of the electrostatic attraction belt 2 is controlled by complementing the data of the linear encoder with data of the rotary encoder before the border (joint area) of the linear scale reaches the encoder sensor 11. Thereby, position control can be prevented from degrading at the border (joint area) of the linear scale.

Furthermore, the outputs of the linear encoder (encoder sensor 11) and the rotary encoder (encoder sensor 9) are processed as rectangular digital signals. Since the outputs of the linear encoder and the rotary encoder are digital signals, the above-described multiplication operation (in this example, multiplied to 4 in the rotary encoder output) and/or various calculation operation (for example, calculation of speed with use of a counter) can be performed easily. This also prevents degradation of precision due to staining of the linear scale (electrostatic attraction belt 2) or the code wheel 8, to thereby attain satisfactory endurance and high reliability. Since printing is executed by moving (main scanning) the cartridge 21 in over the upper surface of the electrostatic attraction belt 2, the electrostatic attraction belt 2 is susceptible to staining. Nevertheless, degradation caused by the staining can be reduced by using digital signals as the linear encoder output signals.

The output signals of the encoders are, however, not limited to digital signals. Alternatively, analog signals may also be used. High resolution can be achieved with the use of analog signals as the output signals. Furthermore, by using analog signals for controlling the stop position of the electrostatic attraction belt (conveyor belt) 2, the electrostatic attraction belt 2 can be stopped more accurately with respect to a target position.

Next, a control portion 60 of the inkjet recording apparatus 100 shown in FIG. 1 is described with reference to FIG. 6.

As shown in FIG. 6, the control portion 60 includes, for example, a CPU 61, a ROM 62, a RAM 63, a nonvolatile RAM (NVRAM) 64, a scanner control portion 65, an ASIC 66, an I/O (input/output) portion 67, a host I/F (interface) 68, a head drive control portion 69, a main scan motor drive control portion 70, and a sub-scan motor drive control portion 71.

The scanner control portion 65 controls the scanner portion (image reading portion) 30. The I/O portion 67 receives output signals from, for example, the linear encoder (encoder sensor 11) and the rotary encoder (encoder sensor 9). Furthermore, the I/O portion 67 may also receive output signals from the linear encoder 38 that outputs signals in correspondence to the movement (main scanning) of the carriage 21 (see FIG. 1). The host I/F 68 exchanges data and/or control signals with external devices such as a personal computer. Furthermore, the control portion 60 inputs/outputs signals with respect to a control panel 36.

The head drive control portion 69 controls the carriage 21 and the recording head (print head) 22 via a head driver 90. The main scan motor drive control portion 70 controls a main scan motor 37 via a main scan motor driver 91 for controlling the movement of the carriage 21 in the main scanning direction. The sub-scan motor drive control portion 71 controls a sub-scan motor 39 via the sub-scan motor driver 76 for controlling the sub-scan drive portion including, for example, the conveying roller 3 and the electrostatic attraction belt 2.

Although not shown in FIG. 6, the control portion 60 also controls, for example, the cassette 27 and the paper feed rollers 24 disposed in the inkjet recording apparatus 100 and/or the conveying rollers 25 and the discharge roller 26 disposed in the recording paper conveyance path (paper conveyance portion).

Although the present invention is described by referring to the above-described drawings, the present invention is not to be limited to the foregoing description.

For example, although the electrostatic attraction belt 2 is described as an example of a conveying part for conveying the recording paper in the sub-scanning direction, a typical conveyor belt may alternatively be employed. In this case, however, it is preferable to provide the conveyor belt with a part having an attracting function (e.g. use of negative pressure), so as to prevent deviation of recording paper and attain more precise conveyance/stop performance.

Furthermore, the location at which the linear scale is disposed is not limited to the rear face of the conveying part (conveyor belt), but may be given another location (e.g. front face of the conveyor belt). It is, however, preferable to dispose the linear scale at the rear face of the conveyor belt for avoiding ink stains, etc. The sensor for reading the linear scale may be situated at a position where the linear scale is disposed.

The location at which the code wheel included in the rotary encoder is not limited to the conveying roller, but may be another location. For example, the code wheel may alternatively be disposed on the axle of the sub-scan drive motor, the axle of an intermediary gear, or the axle of the tension roller 4 (shown in FIG. 2). Furthermore, a roller member, for example, that abuts and is driven by the conveyor belt may be provided for allowing the code wheel to be disposed on the axle of the roller member.

Furthermore, various methods may be employed in fabricating the linear scale. A scale can be obtained as long as contrasts in the strength of reflected light can be formed. For example, the linear scale may be fabricated by applying an aluminum evaporated tape and shaping the surface of the aluminum evaporated tape with a laser. As another method, the linear scale may be fabricated by forming black and white contrasts on a surface of a white color tape by irradiating a laser thereto. Furthermore, various configurations may be applied to the sensors of the linear encoder and the rotary encoder. For example, in a case of using a photosensor, a transparent type sensor or a reflection type sensor may be employed depending on the configuration of the encoder.

Furthermore, as described above, the output signals of the encoder sensors are not limited to digital output signals, but may alternatively be analog output signals. Furthermore, the type of control is not limited to closed-loop control (feedback control), but may alternatively be open loop control.

The number of colors used for the inkjet recording apparatus of the present invention is not limited to four colors, but may be of a given number of colors. Furthermore, a given number of heads may provided in the inkjet recording apparatus of the present invention. Alternatively, the ink cartridge may be included in the head part, instead of being formed separately from the head. The configuration of the scanner portion or inclusion of an ADF (Automatic Document Feeder) is optional. The image forming apparatus may alternatively be a multi-functional apparatus including a facsimile function and/or a printer function. The image forming apparatus may alternatively be a printer without a scanner portion.

Further, the present invention is not limited to these embodiments, but variations and modifications may be made without departing from the scope of the present invention.

The present application is based on Japanese priority application No.2004-141094 filed on May 11, 2004, with the Japanese Patent Office, the entire contents of which are hereby incorporated by reference.

What is claimed is:

1. A conveying apparatus comprising:

a conveyor belt formed as a loop configured to convey an object, the conveyor belt including a linear encoder having a linear scale provided on a rear face of the conveyor belt;

a driving part for driving the conveyor belt, the driving part including a rotary encoder having a resolution higher than the linear encoder of the conveyor belt;

a control part configured to calculate a required number of pulses of signals output from the linear encoder and the rotary encoder for moving the conveyor belt a predetermined amount, by using a formula of $N=a \cdot n1+n2$;

wherein "a" is a correlation function representing a ratio between "L1" and "L2"($a=L1/L2$), wherein "L1" is the amount of conveyance of the conveyor belt corresponding to a single pulse of a signal output from the linear encoder, wherein "L2" is the amount of conveyance of the conveyor belt corresponding to a single pulse of the signal output from the rotary encoder, wherein "n1" is the number of pulses of the signals of the linear encoder having the lower resolution, wherein "n2" is an integer that satisfies a relation of $0 \leqq n2 < a$;

wherein the control part controls the amount of conveyance according to the number of pulses of signals n1 and n2 output from the linear encoder and the rotary encoder;

wherein the linear encoder includes a first sensor positioned within the loop of the conveyor belt for reading the linear scale provided on the rear face of the conveyor belt.

2. The conveying apparatus as claimed in claim 1, wherein the linear scale is fabricated by aluminum evaporation.

3. The conveying apparatus as claimed in claim 1, further comprising:

a border detection sensor for detecting a border of the linear scale;

wherein data of the linear encoder is complemented with data of the rotary encoder when the border detection sensor detects the border of the linear scale.

4. The conveying apparatus as claimed in claim 1, wherein the resolution of the linear encoder is no less than 100 LPI.

5. The conveying apparatus as claimed in claim 1, wherein the resolution of the rotary encoder is no less than 300 LPI.

6. The conveying apparatus as claimed in claim 1, wherein the output signal of the rotary encoder is multiplied by a predetermined value.

7. An inkjet recording apparatus comprising:

the conveying apparatus as claimed in claim 1, the conveying apparatus being mounted onto an inkjet engine portion for conveying recording paper in a sub-scanning direction.

8. The conveying apparatus as claimed in claim 1, wherein the rotary encoder includes a code wheel mounted on the driving part and a second sensor for reading the code wheel.

9. The conveying apparatus as claimed in claim 8, wherein the linear encoder and the rotary encoder output a predetermined signal in accordance with the reading from the linear scale and the code wheel, respectively, wherein the predetermined signal includes a rectangular digital signal.

10. The conveying apparatus as claimed in claim 8, wherein the linear encoder and the rotary encoder output a predetermined signal in accordance with the reading from the linear scale and the code wheel, respectively, wherein the predetermined signal includes an analog signal.

* * * * *